US006371828B1

(12) United States Patent
Ngan

(10) Patent No.: US 6,371,828 B1
(45) Date of Patent: Apr. 16, 2002

(54) HAND DRIVEN TOY

(75) Inventor: Chi-Wing Ngan, Kowloon (HK)

(73) Assignee: May Cheong Toy Products Fty. Ltd., Kowloon (CN)

( * ) Notice: Subject to any disclaimer, the term of this patent is extended or adjusted under 35 U.S.C. 154(b) by 0 days.

(21) Appl. No.: 09/484,618

(22) Filed: Jan. 18, 2000

(51) Int. Cl.[7] ..... A63H 33/02

(52) U.S. Cl. ..... 446/450; 446/440; 446/327; 446/411

(58) Field of Search ..... 446/450, 440, 446/451, 327, 441, 411, 412, 413, 460–468

(56) References Cited

U.S. PATENT DOCUMENTS 4,938,698 A * 7/1990 Chantry ..... 446/327

6,146,237 A * 11/2000 Rehkemper et al. ..... 446/440

* cited by examiner

*Primary Examiner*—Jacob K. Ackun, Jr.
*Assistant Examiner*—Urszula M. Cegielnik
(74) *Attorney, Agent, or Firm*—Alix, Yale & Ristas, LLP

(57) ABSTRACT

A hand-driven toy (100) for playing by hand (10) of a player, which toy comprises a body (110), front and rear wheels (120 & 130), and a steering member (140) for steering the front wheel (120). The toy (100) includes a pair of finger connectors (150) attachable to the steering member (140) for enabling the index and middle fingers (12 & 13) of the hand (10) to maneuver the steering member (140). Each connector (150) resembles a gauntlet (150) having a fist (152) for gripping a respective opposite part (142) of the steering member (140) and a cuff (156) for frictional engagement by a respective finger (12/13) such that the toy (100) may be held and driven by the hand (10) to move on a surface.

5 Claims, 3 Drawing Sheets

HAND DRIVEN TOY

The present invention relates to a hand-driven toy for playing by the hand and in particular the fingers of a player.

BACKGROUND OF THE INVENTION

Wheeled toys for playing by the hand of a player are generally known. Invariably, such toys do not have any specific parts that are specially designed to facilitate holding by the fingers for the toys to be driven on a surface in a lifelike manner.

The invention seeks to mitigate or at least alleviate such a problem by providing an improved hand-driven toy.

SUMMARY OF THE INVENTION

According to the invention, there is provided a hand-driven toy for playing by a hand of a player, which toy comprises a body, front and rear wheels supported by the body for rotation, a steering member on the body for steering the front wheel, and a pair of finger connectors attachable to the steering member for enabling the index and middle fingers of said hand to manoeuvre the steering member, each of said connectors having a front part engageable with a respective opposite of the steering member and a rear part for frictional engagement by a respective one of said fingers such that the toy may be held and driven by said hand to move on a surface.

Preferably, the rear part of each connector is hollow and opens rearwards for the insertion of a respective finger.

More preferably, the rear part of each connector is tapered in a forward direction.

It is preferred that the front part of each connector is formed with a cavity for engaging the respective part of the steering member.

In a preferred embodiment, the connectors resemble a pair of gauntlets, each having a fist as the front part and a cuff as the rear part.

More preferably, the connectors are removable from the steering member.

As a first example, the hand-driven toy is in the form of a motorcycle having a handle bar as the steering member.

As a second example, the hand-driven toy is in the form of a motor car having a steering wheel as the steering member.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENTS

Figure 1:
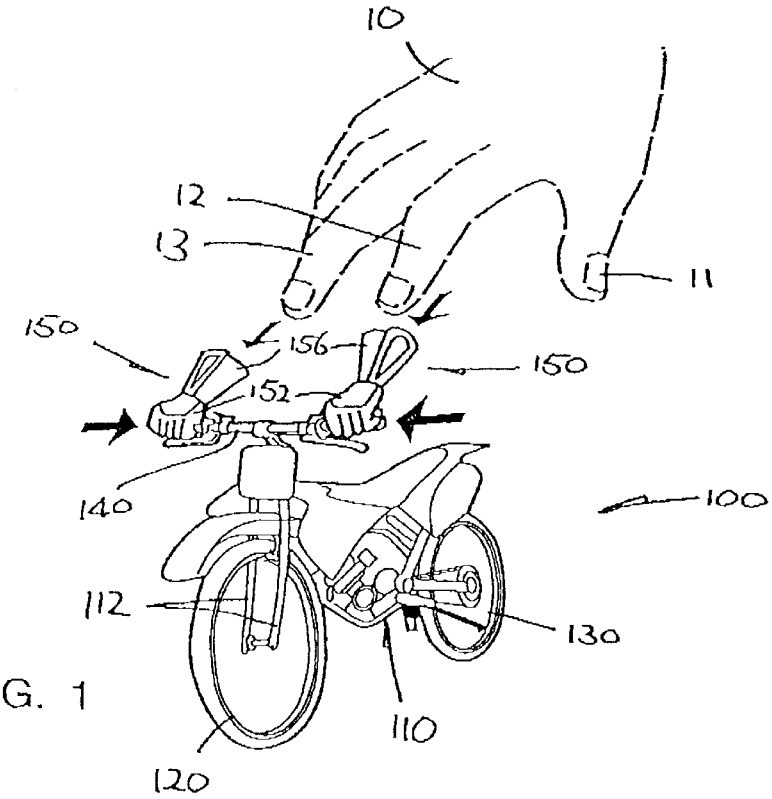
FIG. 1 is a front perspective view of a first embodiment of a hand-driven toy in accordance with the invention, said toy incorporating a pair of finger connectors for connecting two fingers of a player.
Figure 3:
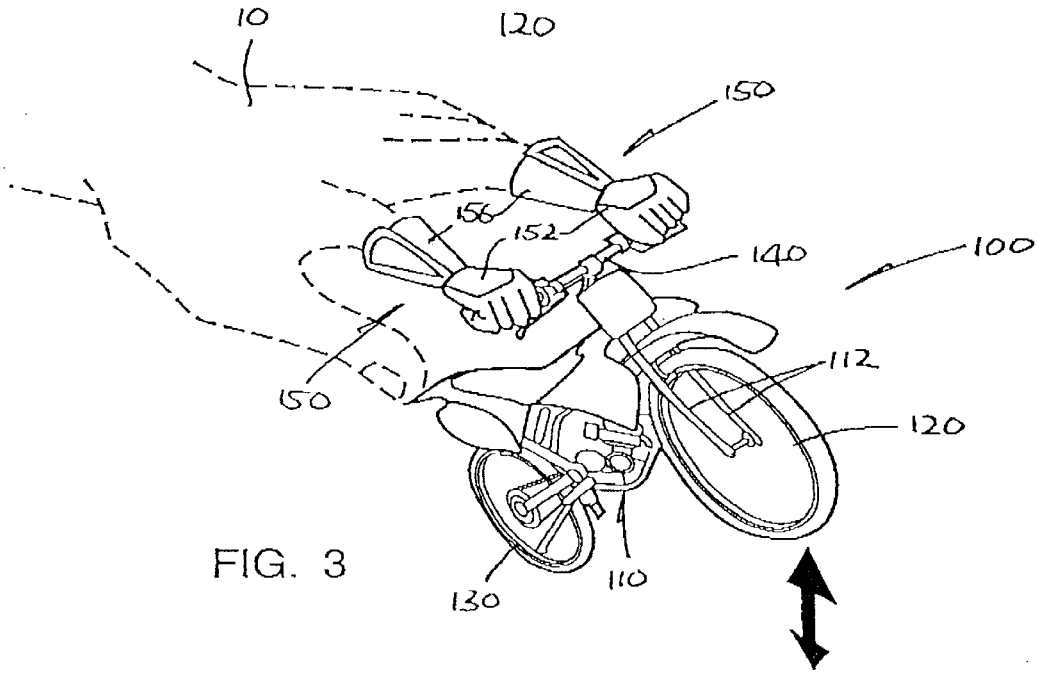
FIG. 3 is a perspective view corresponding to FIG. 1, showing the toy in a wheelie action.
Figure 2:
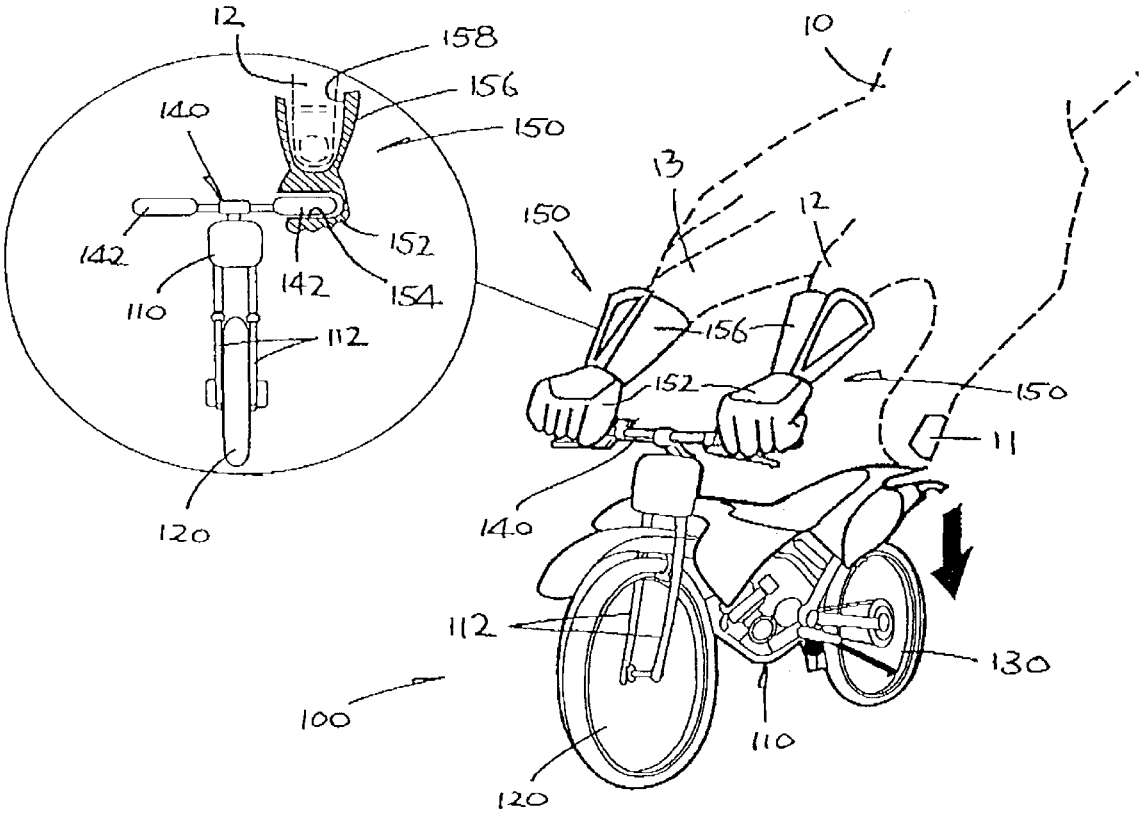
FIG. 2 is a perspective view corresponding to FIG. 1, showing the toy in a braking action and how the connectors are used.

Referring initially to FIGS. 1 to 3 of the drawings, there is shown a first hand-driven toy embodying the invention, which toy is in the form of a motorcycle 100 having a body frame 110 including from forks 112, a pair of front and rear wheels 120 and 130, and a handle bar 140. The body frame 110 supports the rear wheel 130, and the front forks 112 support the front wheel 120 below and the handle bar 140 atop. The front forks 112 are pivotably connected with respect to the body frame 110 such that the front wheel 120 may be steered by means of the handle bar 140. The handle bar 140 provides a pair of elongate handgrips 142 at opposite ends.

The motorcycle 100 incorporates two finger connectors resembling a pair of gauntlets 150. Each gauntlet 150 has a fist 152 formed with a laterally-extending cavity or blind hole 154 and includes a cuff 156 forming a hollow receptacle 158 which opens rearwards and is tapered in a forward direction. The gauntlets 150 are removably attached to the handle bar 140 by having their first holes 154 engaging around the respective handgrips 142 like gripping, with the cuffs 156 or receptacles 158 facing at an acute angle upwards and rearwards.

The motorcycle 100 is to be played by a right (or left) hand 10 of a player, using his thumb 11 and index and middle fingers 12 and 13. The index and middle fingers 12 and 13 should be inserted into the receptacles 158 of the respective left and right gauntlets 150 for frictionally engaging and thus manoeuvring the handle bar 140, with the thumb 11 pressing on the rear end of the body frame 110. The thumb 11 and fingers 12 and 13 co-operate to hold (or grab) the motorcycle 100 and move it on a surface, such as the floor or a desktop, in a lifelike or realistic driving manner.

The index and middle fingers 12 and 13 determine the travelling direction of the motorcycle 100 by turning the handle bar 140. Pressing of the thumb 11 relatively harder on the body frame 110 will simulate a braking action (FIG. 2). The rear wheel 130 may be provided with spring suspension for being lifelike and added fun and/or a brake for actual braking. Raising of the fingers 12 and 13 relative to the thumb 11 will cause the motorcycle 100 to simulate a wheelie action (FIG. 3).

Figure 4:
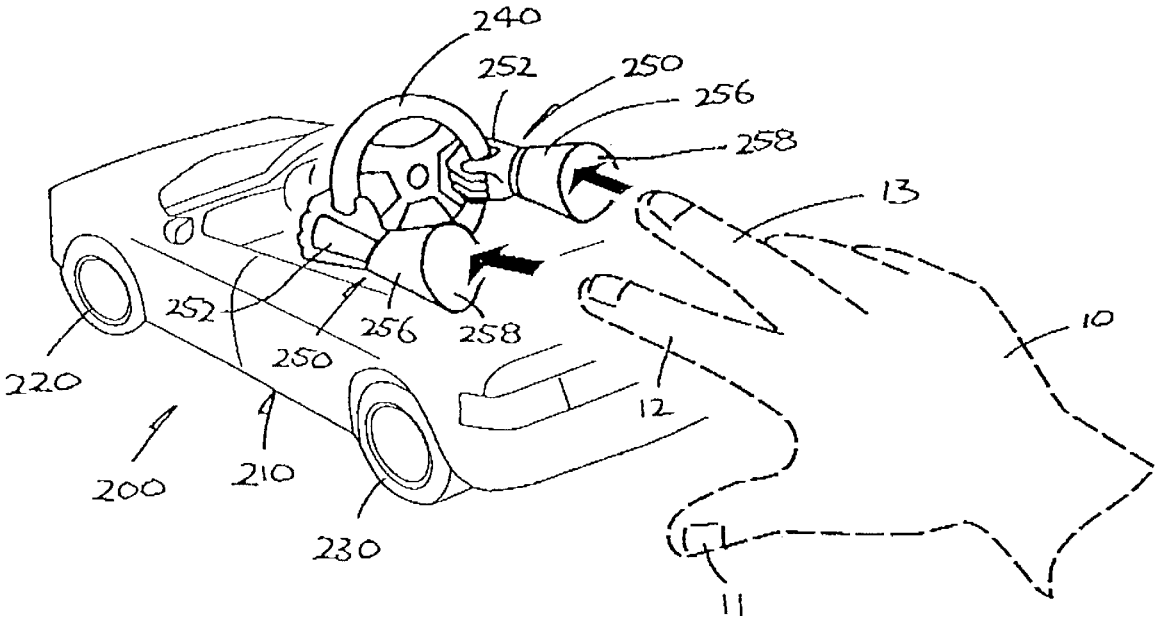
FIG. 4 is a rear perspective view of a second embodiment of a hand-driven toy in accordance with the invention, said toy incorporating a pair of finger connectors for connecting two fingers of a player.
Figure 5:
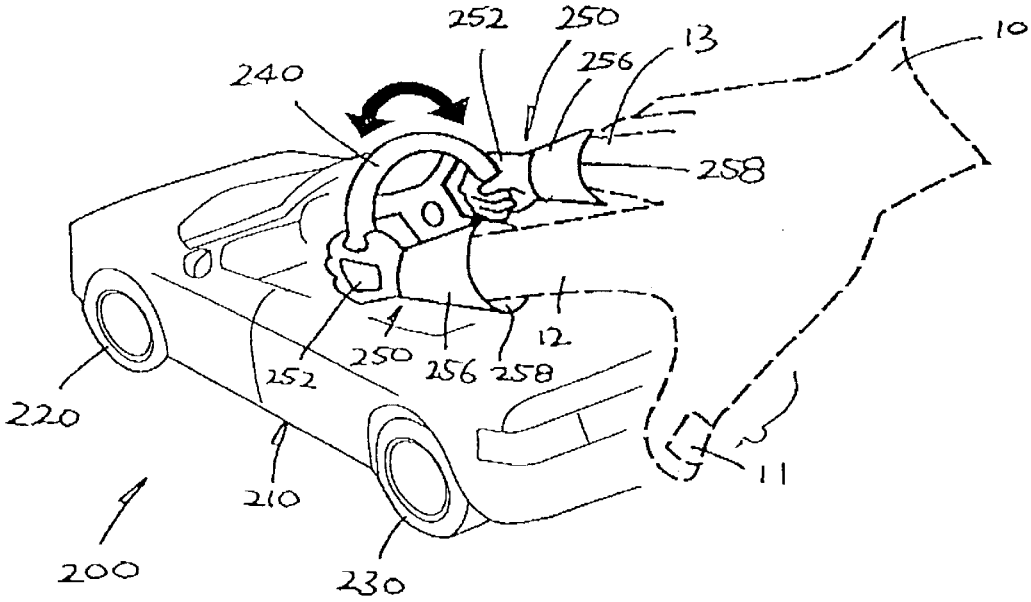
FIG. 5 is a perspective view corresponding to FIG. 4, showing how toy is steered by the fingers.

Reference is now made to FIGS. 4 and 5 showing a second hand-driven toy embodying the invention, which toy is in the form of a motor car 200 having a body 210, two pairs of front and rear wheels 220 and 230, and a steering wheel 240 for swivelling the front wheels 220. Like the motorcycle 100, the motor car 200 incorporates a pair of gauntlets 250 as finger connectors. Each gauntlet 250 has a half-clenched fist 252 and a cuff 256 forming a receptacle 258 similar to the previous receptacle 158. The gauntlets 250 are releasably attached to the steering wheel 240 by having their fists 252 gripping opposite sides of the steering wheel 240, with the cuffs 256 or receptacles 258 facing at an acute angle upwards and rearwards.

The motor car 200 is to be played by a right (or left) hand 10 of a player, using his thumb 11 and index and middle fingers 12 and 13. The index and middle fingers 12 and 13 should be inserted into the receptacles 258 of the respective left and right gauntlets 250 for frictionally engaging and thus manoeuvring the steering wheel 240, with the thumb 11 pressing on the rear end of the body 210. The thumb 11 and fingers 12 and 13 co-operate to hold (or grab) the motor car 200 and drive it on a surface in a realistic manner. The index and middle fingers 12 and 13 determine the travelling direction of the motor car 200 by turning the steering wheel 240.

It is envisaged that the subject hand-driven toy may take any other different forms in terms of the general design, such as an in-line roller skate, a conventional roller skate or a skateboard.

The invention has been given by way of example only, and various other modifications of and/or alterations to the described embodiments may be made by persons skilled in the art without departing from the scope of the invention as specified in the appended claims.

What is claimed is:

1. A hand-driven toy for playing by a hand of a player, which toy comprises a body, front and rear wheels supported by the body for rotation, a steering member on the body for steering the front wheel, and a pair of finger connectors removably attachable to the steering member fro enabling the index and middle fingers of said hand to maneuver the steering member, each of said connectors having a front part defining a cavity, said front part engageable with a respective opposite part of the steering member so that said respective opposite part is received in said cavity and a rear part for frictional engagement by a respective one of said fingers such that the toy may be held and driven by said hand to move on a surface.

2. The hand-driven toy as claimed in claim 1, wherein the rear part of each connector is hollow and opens rearwards for the insertion of a respective finger.

3. The hand-driven toy as claimed in claim 2, wherein the rear part of each connector is tapered in a forward direction.

4. The hand-driven toy as claimed in claim 1, being in the form of a motorcycle having a handle bar as the steering member.

5. The hand-driven toy as claimed in claim 1, being in the form of a motor car having a steering wheel as the steering member.

* * * * *

UNITED STATES PATENT AND TRADEMARK OFFICE

CERTIFICATE OF CORRECTION

PATENT NO. : 6,371,828 B1
DATED : April 16, 2002
INVENTOR(S) : Ngan

It is certified that error appears in the above-identified patent and that said Letters Patent is hereby corrected as shown below:

Column 3,
Line 18, after "steering member" change "fro" to -- for --.

Signed and Sealed this

Twentieth Day of August, 2002

*Attest:*

*Attesting Officer*

JAMES E. ROGAN
*Director of the United States Patent and Trademark Office*